US008608001B2

(12) United States Patent
Stoneberg et al.

(10) Patent No.: US 8,608,001 B2
(45) Date of Patent: Dec. 17, 2013

(54) MOLD-IN-PLACE TWO SHOT SEAL

(75) Inventors: Thomas C. Stoneberg, Buffalo Grove, IL (US); William C. Schmeisser, Barrington, IL (US)

(73) Assignee: Berry Plastics Corporation, Evansville, IN (US)

( * ) Notice: Subject to any disclaimer, the term of this patent is extended or adjusted under 35 U.S.C. 154(b) by 1755 days.

(21) Appl. No.: 11/751,971

(22) Filed: May 22, 2007

(65) Prior Publication Data

US 2008/0035674 A1 Feb. 14, 2008

Related U.S. Application Data

(63) Continuation-in-part of application No. 11/740,074, filed on Apr. 25, 2007, now Pat. No. 7,887,731.

(60) Provisional application No. 60/803,026, filed on May 23, 2006, provisional application No. 60/745,560, filed on Apr. 25, 2006.

(51) Int. Cl.
*B65D 47/00* (2006.01)

(52) U.S. Cl.
USPC ..... 215/235; 222/562; 222/563; 220/837; 220/839; 215/293; 215/306

(58) Field of Classification Search
USPC ..... 220/837, 255, 256.1, 839; 222/556, 222/554, 546, 562, 563; 215/235, 293, 306; 264/255
See application file for complete search history.

(56) References Cited

U.S. PATENT DOCUMENTS

| | | | | |
|---|---|---|---|---|
| 2,074,830 | A | 3/1937 | Conner | |
| 2,394,135 | A | 2/1946 | Baar | |
| 3,958,708 | A | 5/1976 | Le Brun, Jr. | |
| 4,308,965 | A | 1/1982 | Dutt | |
| 4,444,329 | A | 4/1984 | Vollers | |
| 4,489,844 | A | 12/1984 | Breskin | |
| 5,176,269 | A | 1/1993 | Herman | |
| 5,431,293 | A | 7/1995 | Piron | |
| 5,439,124 | A * | 8/1995 | Mock | 215/40 |
| 5,501,377 | A | 3/1996 | Dubach | |
| 5,629,029 | A | 5/1997 | Souder et al. | |
| 5,700,500 | A | 12/1997 | Wilhelm | |
| 5,749,484 | A | 5/1998 | Trout | |
| 5,772,076 | A | 6/1998 | Juk et al. | |
| 5,810,185 | A | 9/1998 | Groesbeck | |
| 5,865,353 | A * | 2/1999 | Baudin | 222/546 |

(Continued)

OTHER PUBLICATIONS http://www.okeeffescompany.com/our_products/working_hands/; It shows how the lid fits on the package; Copyright © 2006 Working Hands Creme, Inc.; USA.

*Primary Examiner* — David T. Fidei
*Assistant Examiner* — Raven Collins
(74) *Attorney, Agent, or Firm* — Barnes & Thornburg LLP

(57) ABSTRACT

A two shot dispensing closure wherein the spout and base component of the closure is molded in a first molding step and a repositionable cap is molded over at least the spout of the closure in a second molding step. The cap may be molded in the closed position over the spout to provide a fluidic seal between the cap and spout. The cap is repositionable between a closed position closing off an aperture of the spout and an open position thereby opening the aperture of the spout.

20 Claims, 18 Drawing Sheets

(56) References Cited

U.S. PATENT DOCUMENTS

| | | | | |
|---|---|---|---|---|
| 5,868,273 | A | 2/1999 | Deanen et al. | |
| 5,975,381 | A | 11/1999 | Revenu | |
| 6,029,866 | A | 2/2000 | Wood et al. | |
| 6,036,036 | A | 3/2000 | Bilani et al. | |
| 6,129,880 | A * | 10/2000 | Kieras et al. | 264/230 |
| 6,142,325 | A | 11/2000 | Chomik | |
| 6,257,463 | B1 | 7/2001 | De Polo | |
| 6,305,563 | B1 * | 10/2001 | Elliott | 215/235 |
| 6,481,589 | B2 | 11/2002 | Blomdahl et al. | |
| 6,832,692 | B2 | 12/2004 | Ryall et al. | |
| 6,854,613 | B2 | 2/2005 | Besecker et al. | |
| 6,929,137 | B1 | 8/2005 | Granger et al. | |
| 6,971,531 | B1 * | 12/2005 | Dubach | 215/235 |
| 7,007,817 | B2 | 3/2006 | Jochem | |
| 7,097,790 | B2 | 8/2006 | Joechem | |
| 7,147,118 | B2 | 12/2006 | Bloom et al. | |
| 2005/0121406 | A1 | 6/2005 | Brozell et al. | |
| 2006/0076370 | A1 | 4/2006 | Etesse | |

* cited by examiner

MOLD-IN-PLACE TWO SHOT SEAL

CROSS-REFERENCE TO RELATED APPLICATIONS

This nonprovisional patent application claims priority to and benefit from U.S. provisional patent application Ser. No. 60/803,026, filed on May 23, 2006, under 37 CFR §119(e) and is a continuation-in-part of currently pending nonprovisional patent application Ser. No. 11/740,074, filed Apr. 25, 2007, which claims priority to and benefit from U.S. provisional patent application Ser. No. 60/745,560, filed on Apr. 25, 2006, under 37 CFR §119(e).

BACKGROUND OF THE INVENTION

1. Field of the Invention

The present application is related to closures for fluid containers utilizing overmolded components; and, more specifically, to closures where the spout and base component of the closure is molded in a first molding step and a repositionable or removable cap is molded over at least the spout of the closure in a second molding step.

2. Brief Discussion of Related Art

Container closures for certain beverage and condiment dispensers include a cylindrical base portion and a spout portion extending from the base portion. The base portion is typically threaded to be mounted to a mount of the dispenser. In this manner, fluid product from the interior of the dispenser is generally withdrawn through the spout portion, and when product is no longer desired to be withdrawn, the spout portion is closed by a removable or repositionable cap. The spout may be closed by a removable overcap or a retained cap repositionably mounted to the spout.

Certain container closures include base and spout portions that are molded with circumferential grooves or channels that are adapted to accept a circumferential ring of the retained cap. With such closures, the base and spout portion and the retained cap are individually molded apart from one another in separate processes. In other words, the base and spout portion is completely molded and the retained cap is completely molded, only thereafter to have the circumferential ring of the retained cap be frictionally fit within the groove of the base and spout portion to allow the cap to be mounted to the base and spout portion even when the cap does not close the orifice in the spout portion. It should be understood that the friction fit is the primary prior art means used to mount the cap to the spout portion.

SUMMARY

The present application is related to closures for fluid containers utilizing overmolded components; and, more specifically, to closures where the spout and base component of the closure is molded in a first molding step and a repositionable or removable cap is molded over at least the spout of the closure in a second molding step.

Accordingly, it is a first aspect of the invention to provide a method of molding a container closure providing selective fluid communication between an interior of a fluid container and an exterior environment, the method comprising: (i) configuring and closing a mold having a first cavity negatively defining a base of a container closure that includes a spout and a container mount, where the spout and container mount cooperate to define a conduit therethrough in fluid communication with an outlet orifice of the spout; (ii) injecting a first material into the first cavity to mold the base; (iii) cooling the first material in the mold to impart at least minimal rigidity to the base; (iv) reconfiguring at least a portion of the mold to define a second cavity adjacent to the first material, the second cavity negatively defining a cap covering the outlet orifice of the spout; (v) injecting a second material into the second cavity to mold the cap over the outlet orifice; (vi) cooling the second material in the mold to impart at least minimal rigidity to the cap; and (vii) removing the base and integrally formed cap from the mold.

It is a second aspect of the present invention to provide a method of overmolding a repositionable cap onto a container closure, the method comprising the steps of: (i) configuring and closing a mold housing a container closure base to at least partially define a mold cavity approximate a spout of the container closure base; (ii) injecting a first material into the mold cavity to overmold a cap over the spout that closes an outlet orifice of the spout; (iii) cooling the second material to impart at least minimal rigidity to the cap; and (iv) removing the base and overmolded cap from the mold.

It is a third aspect of the present invention to provide a method of imparting a tamper evident indicia to an injection molded product, the method comprising: (i) molding a first component of a product; and (ii) molding a second component of the produce over the first component to create a bond between the first component and the second component, where the second component includes at least one of a transparent property and a translucent property so that bonded portions of the first and second components exhibit a color that is a combination of colors of the overmolded portions of the first and second components, where breaking of the bond substantially removes the combination color in the areas where the bond has been broken.

It is a fourth aspect of the present invention to provide a closure for a fluid container comprising: (i) a container fitting including: (a) a distal container receiver adapted to couple the container fitting to a container, thereby providing a fluidic seal between the container fitting and the container; (b) a proximal spout including a conduit therethrough that is in communication with a proximal orifice of the spout through which material flowing through the conduit is adapted to egress from the container fitting; and (c) a lid that is repositionable between a closed position closing off the proximal orifice of the spout, and an open position opening the proximal orifice of the spout, where the lid is molded in the closed position over the proximal spout to provide a sealed fluidic interface between the lid and the spout.

DETAILED DESCRIPTION

Figure 2:
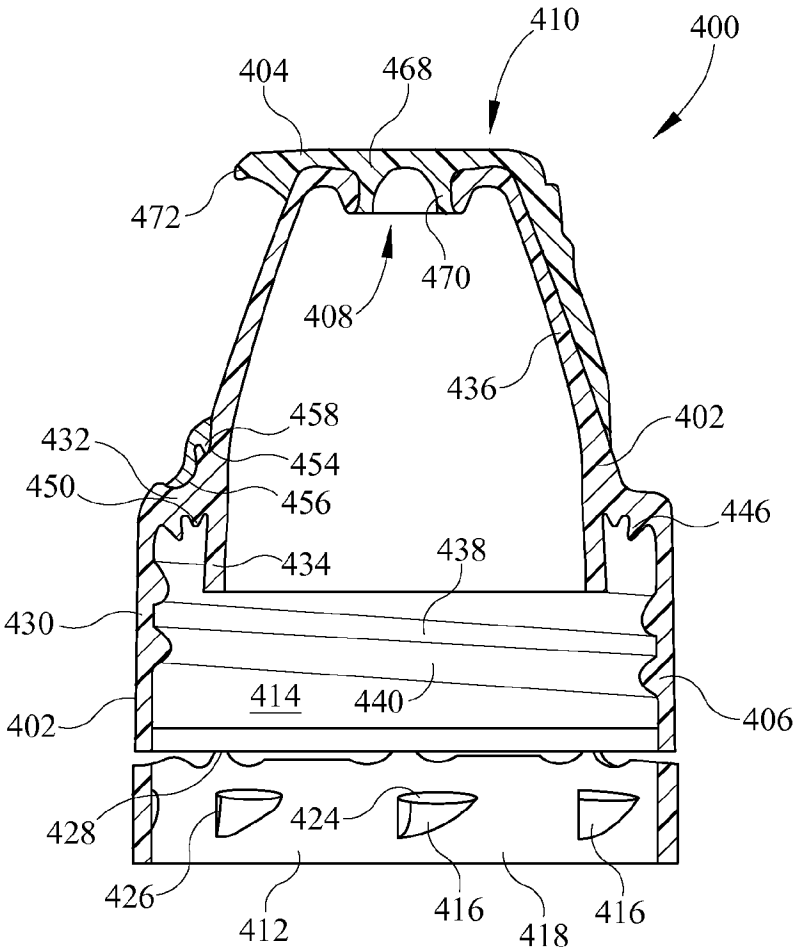
FIG. 2 is a cross-sectional view of the closure of FIG. 1 offset 90 degrees.
Figure 1:
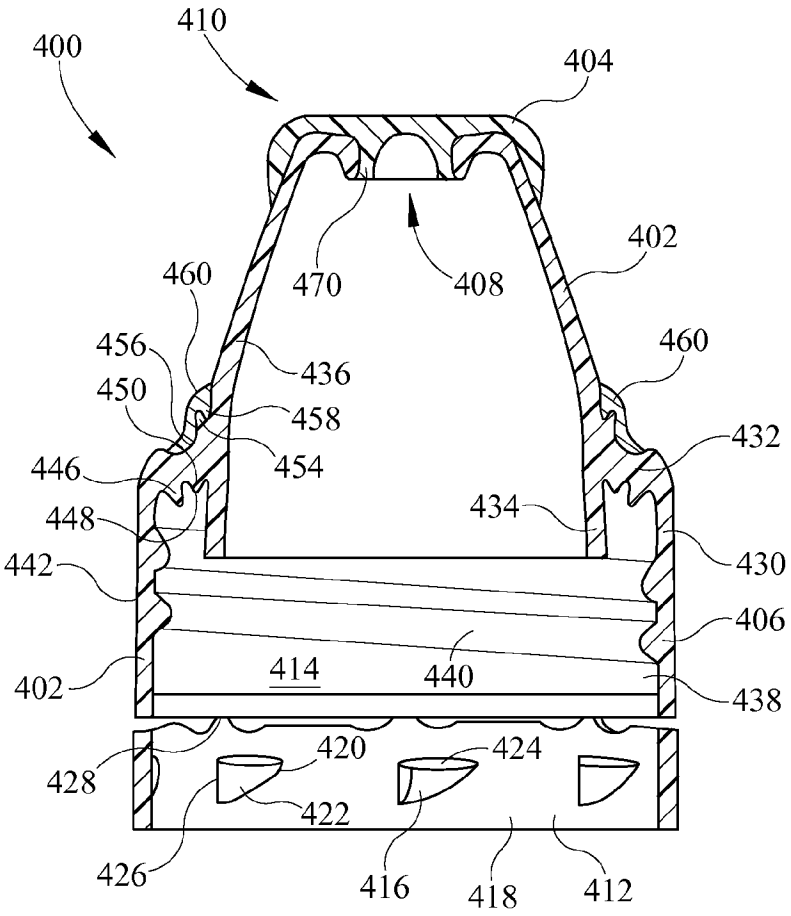
FIG. 1 is a cross-sectional view of an additional exemplary closure in accordance with the present invention.
Figure 3:
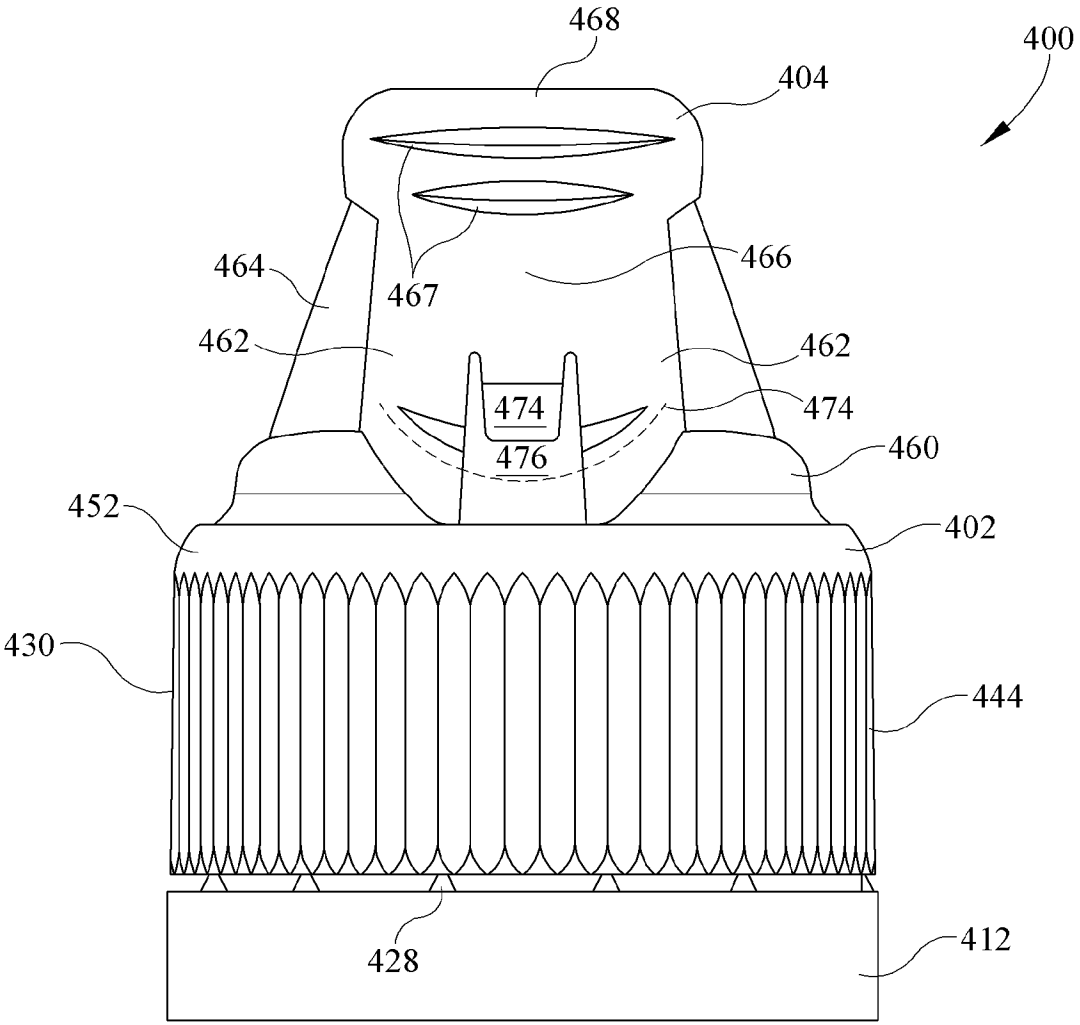
FIG. 3 is a rear perspective view of the closure of FIG. 1.

The exemplary embodiments of the present invention are described and illustrated below to encompass methods of fabricating container closure and the closures produced utilizing such methods. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Referring to FIGS. 1-4, an exemplary closure 400 includes a base 402 and an overmolded repositionable cap 404 that are adapted to cooperate to retain the contents of a container (not shown) when the closure 400 is mounted to the container. The base 402 includes a circumferential wall 406 that forms a conduit through which fluid flows from the interior of the container and out an outlet orifice 408 in the proximal end 410 of the wall. The circumferential wall 406 includes a tamper-evident band 412 connected to a threaded, cylindrical container mating portion 414 that are adapted to be mounted to the throat of the container. The tamper-evident band 412 includes a plurality of projections 416 circumferentially spaced along an interior surface 418 thereof. Each projection 416 includes a contoured leading edge 420 having an arcuate wall 422 that extends radially inward and intersects with a topside ledge 424 and a backside wall 426 that each extend perpendicularly inward from the interior surface 418. A plurality of bridges 428 extend between and connect the tamper-evident band 412 to the container mating portion 414. These bridges 428 are adapted to be broken when the closure 400 is first removed from the container, thereby separating the tamper-evident band 412 from the container mating portion 414. The bridges 428 are broken when either or both of the topside ledge 424 and the backside wall 426 catch one or more corresponding projections from the throat of the container so that continued upward movement of the closure 400 tensions the bridges 428 beyond their breaking points.

The container mating portion 414 includes a cylindrical wall 430 that intersects with a radially inwardly extending wall 432 that transitions concurrently into a circumferential, axially, extending flange 434 and an opposed frustoconical wall 436. The cylindrical wall 430 includes an interior surface 438 having helical threads 440 extending radially inward that are adapted to interact with a corresponding helical projection on the throat of the container to allow the closure 400 to be rotationally mounted and dismounted from the container. An exterior surface 442 of the cylindrical wall 430 includes a plurality of vertically oriented and spaced apart ribs 444 adapted to enable a user to more easily grip and rotate the closure 400 with respect to the container.

The cylindrical wall 430, the radially inwardly extending wall 432, and the circumferential flange 434 cooperate to define a circumferential inverted U-shaped profile that is adapted to be seated upon the top wall of the mouth of the container. A circumferential projection 446 extends from an interior surface 448 of the radially inwardly extending wall 432 and cooperates with the flange 434 to guide a top wall of the mouth of the container into contact with a sealing ring 450 also extending from the radially inwardly extending wall 432. The sealing ring 450 is adapted to compress and seal against the top wall of the mouth of the container when the closure 400 is mounted to the container.

An exterior surface 452 of the radially inwardly extending wall 432 includes a circumferential lip 454 that separates complementary circumferential grooves 456, 458. Each groove 456, 458 receives part of a retaining ring 460 molded thereover to mount the repositionable cap 404 to the base 402. As will be discussed in more detail below, the lip 454 increases the surface area for bonding between the retaining ring 460 and the base 402, thereby providing a more secure connection. Two legs 462 that are bonded to an exterior surface 464 of the frustoconical wall 436 extend from the retaining ring 460. The legs 462 converge to form a backbone 466 that extends parallel to exterior surface 464 of the frustoconical wall 436, where the proximal segment of the backbone 466 includes rigidity ribs 467 that transition into a lid 468 that is removably bonded to the proximal end 410 of the circumferential wall 406 to close the outlet orifice 408 of the spout formed by the frustoconical wall 436 and completely cover the entire exposed surface of the proximal end 410. The lid 468 includes a downwardly extending circumferential plug 470 that is adapted to be frictionally received by the outlet orifice 408 to seal the outlet orifice. A tapered lip 472 of the lid 468 overhangs the exterior surface 464 of the frustoconical wall 436 and is adapted to receive an upward manual force. When manual force is applied upwardly against the lip to force the lid off of the spout and the plug 470 from the outlet orifice 408, the reduced thickness of the legs 462 to provide a living hinge 474 about which the backbone 466 and lid 468 pivot with respect to the retaining ring 460 and the base 402. The backbone 466 includes an outwardly extending prong 474 that is adapted to be pivoted inwardly and be received by a corresponding depression 476 within the exterior surface 464 of the frustoconical wall 436, thereby retaining the hinge in the open position. When the backbone 466 and lid 468 pivot approximately 90° or more, the prong 474 continues to extend outward from the backbone 466 and is wedged against the exterior surface 464 of the frustoconical wall 436 to retain the backbone 466 and lid 468 in the pivoted position. A force applied to one or more of the top of the lid 468 and the back side of the backbone 466 is operative to deform the prong 474 out from the depression 476 allowing the backbone 466 and lid 468 to pivot to the closed position.

Referencing FIGS. 4-7, the exemplary closure 400 is fabricated in a two-shot injection molding process. In the first shot, the first and second blocks 500, 502 of the mold 504 are brought together to provide an internal cavity having negative dimensions and features representative of the base 402 discussed above. A polymer, such as polypropylene, is injected into the cavity to form the base 402. The polymer is allowed to sufficiently harden so that the mold 504 may be opened without substantially deforming the base 402. The first block 500 of the mold 504 is thereafter withdrawn from the second block 502 to remove the base 402 from the second block 502 and expose the exterior surface 452 of the radially inwardly extending wall 432 and the exterior surface 464 of the frustoconical wall. A third block 508 of the mold 504 is then brought into contact with the first aspect 500 to provide an internal cavity having dimensions and features representative of the repositionable cap 404 discussed above, adjacent to the exposed portions of the base 402. A second polymer, such as polyethylene, is injected into the cavity to form the repositionable cap 404 in a second shot over the exposed portions of the base 402. The polymer forming the repositionable cap 404 is allowed to sufficiently harden so that the mold 504 may be opened without substantially deforming the cap 404. Thereafter, the third block 506 is separated from the first block 500 and a finished closure 400 is removed from the first block 500.

Referring to FIGS. 1-7, the two-shot process discussed above molds the repositionable cap 404 to the base 402 so as to form a band and a seal at the interface between the two components. This is particularly advantageous where, as here, the molding process molds the cap 404 in not only a closed position, but with a fluidic seal with respect to the outlet orifice 408 in the proximal end 410 of the base 402 and the lid 468.

Figure 7:
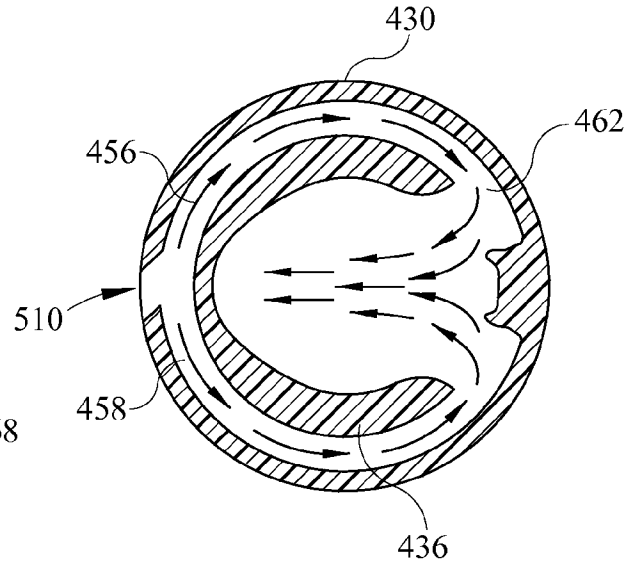
FIG. 7 is an overhead, cut-away view of the mold of FIG. 6 showing the flow of the polymer to form the second aspect of the closure.
Figure 4:
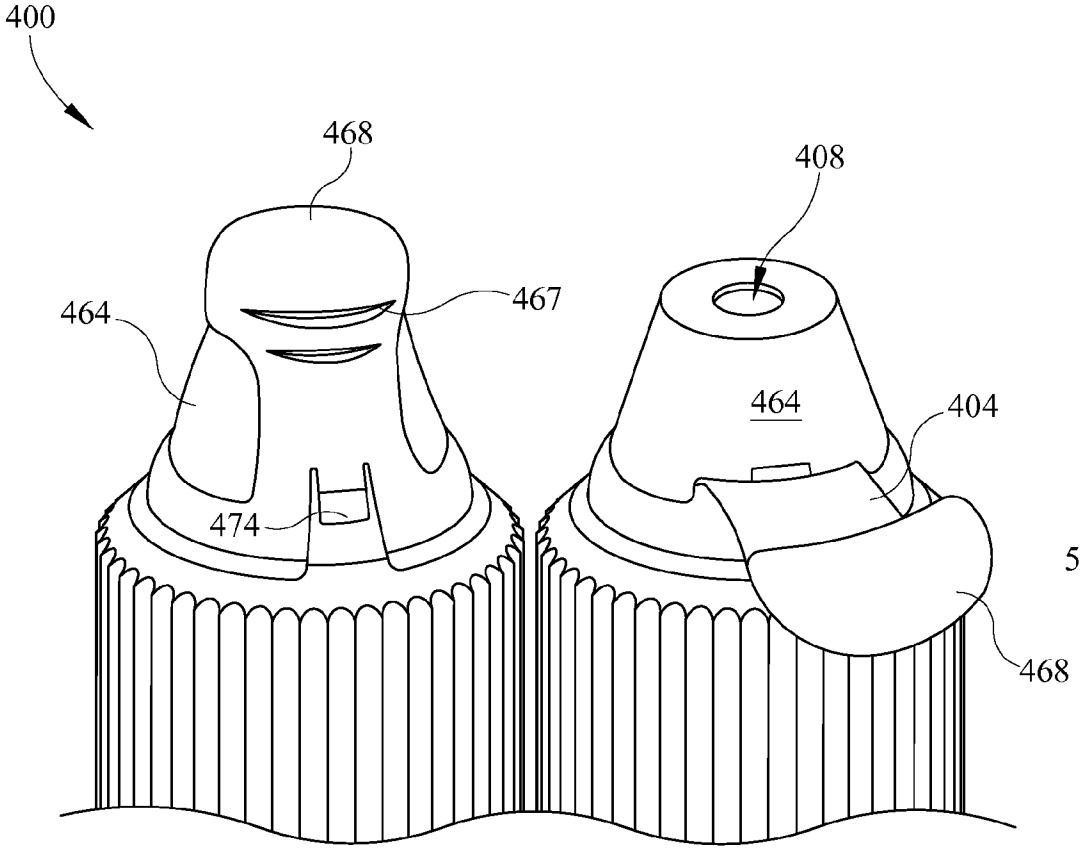
FIG. 4 is an elevated perspective view of the closure of FIG. 1, where the lid is in the open and closed position.
Figure 6:
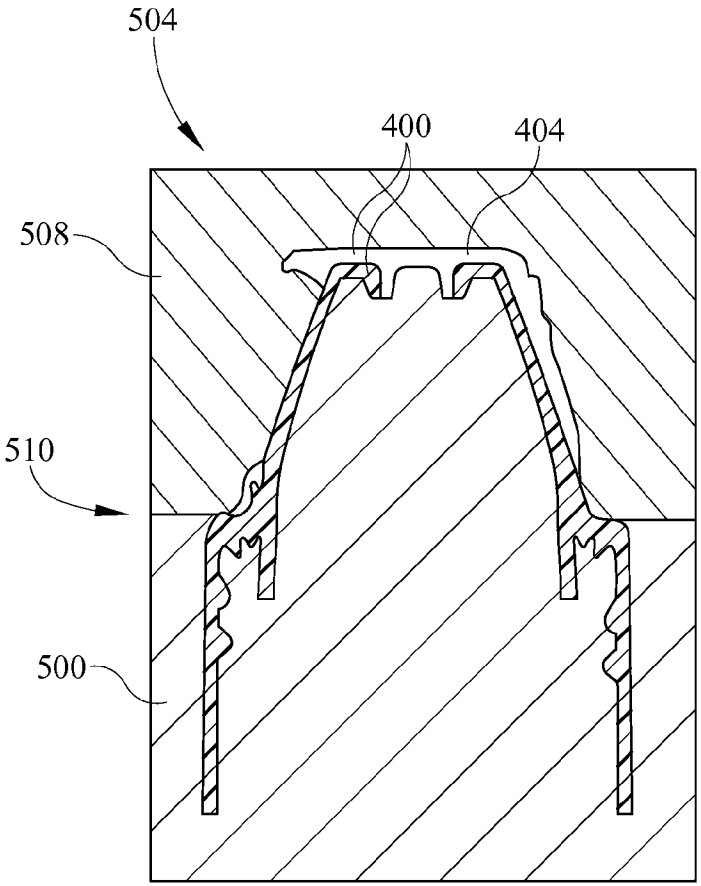
FIG. 6 is a cross-sectional view of an exemplary mold to fabricate a second aspect of the closure of FIG. 1, thereby finishing the molding of the closure as shown in FIG. 1.
Figure 5:
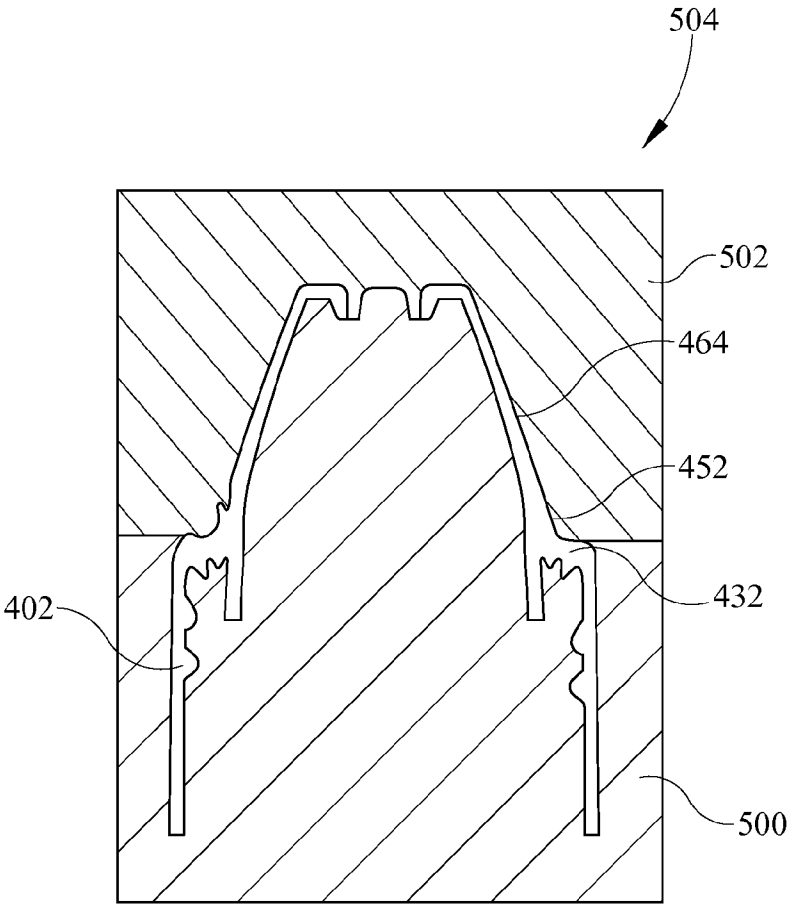
FIG. 5 is a cross-sectional view of an exemplary mold to fabricate a first aspect of the closure of FIG. 1.

FIG. 7 provides an exemplary injection point 510 where the second polymer is first introduced to fill those aspects of the circumferential grooves 456, 458 farthest from the legs 462. It is important to understand that injection molded polymers flow like streams of viscous fluids. As more polymer is introduced, the pressure and additional polymer force the initially injected polymer outward and around the frustoconical wall 436 in two arcuate polymer streams. As further polymer is introduced, the polymer at the lead end of each stream begins to cool and becomes more resistant to flow. The polymer material continues to flow in these two streams to form the legs 462, until the two polymer streams converge to form the backbone 466 and lid 468, thereby completely covering and sealing the outlet orifice 408 in the proximal end 410 of the base 402. The mold 504 is designed so that the molding of the lid 468 and the backbone 466 coincide with the lead end polymer becoming increasingly viscous so much so that the injection molding equipment can no longer inject polymer to force the lead end material further into the mold.

In a further exemplary application of the two-shot molding process, the repositionable cap 404 and the base 402 include a tamper evident indicia visually apparent when the seal between the cap 404 and base 402 has not been compromised. For example, the base may be fabricated from a blue polyethylene material and the cap may be fabricated from a yellow polyethylene material that is substantially transparent and/or translucent. Thus, the overmolded portions of the cap will exhibit a green color combination of blue and yellow materials being bonded to one another. In this example, the yellow polyethylene material is transparent so that an overhead view of the closure 400 after molding would reveal a dark green ring around a yellow circle, evidencing that the seal was intact between the cap 404 and base 402, particularly with respect to the seal between the outlet orifice 408 and the circumferential plug 470. When a user of the closure 400 first peels the lid 468 back to displace the circumferential plug 470 from the outlet orifice 408, thereby discontinuing the seal therebetween, the overhead view of the closure 400 would reveal a very faint green ring around a yellow circle (or no green color at all), evidencing that the seal was no longer intact between the cap 404 and base 402, particularly with respect to the seal between the outlet orifice 408 and the circumferential plug 470. The absence of the dark green ring would alert a potential user than the lid has been previously been opened.

Simply put, the visual indicia is the difference in appearance when the cap and base continue to have a bond or a seal therebetween and the appearance when no bond/seal is present between the cap and base. In other words, the absence of presence of a visual cue alerts the user of the sealed or unsealed state. Along these same lines, it is also within the scope of the invention that the dominant visual cue be apparent after the cap has been initially repositioned from the base, thereby discontinuing the bond/seal therebetween. Those of ordinary skill will readily understand that various color combinations can be utilized to provide a color change once a molded seal is discontinued, such as, without limitation, a red base 402 and a yellow cap 404, and a blue base 402 and a red cap 404.

Figure 8:
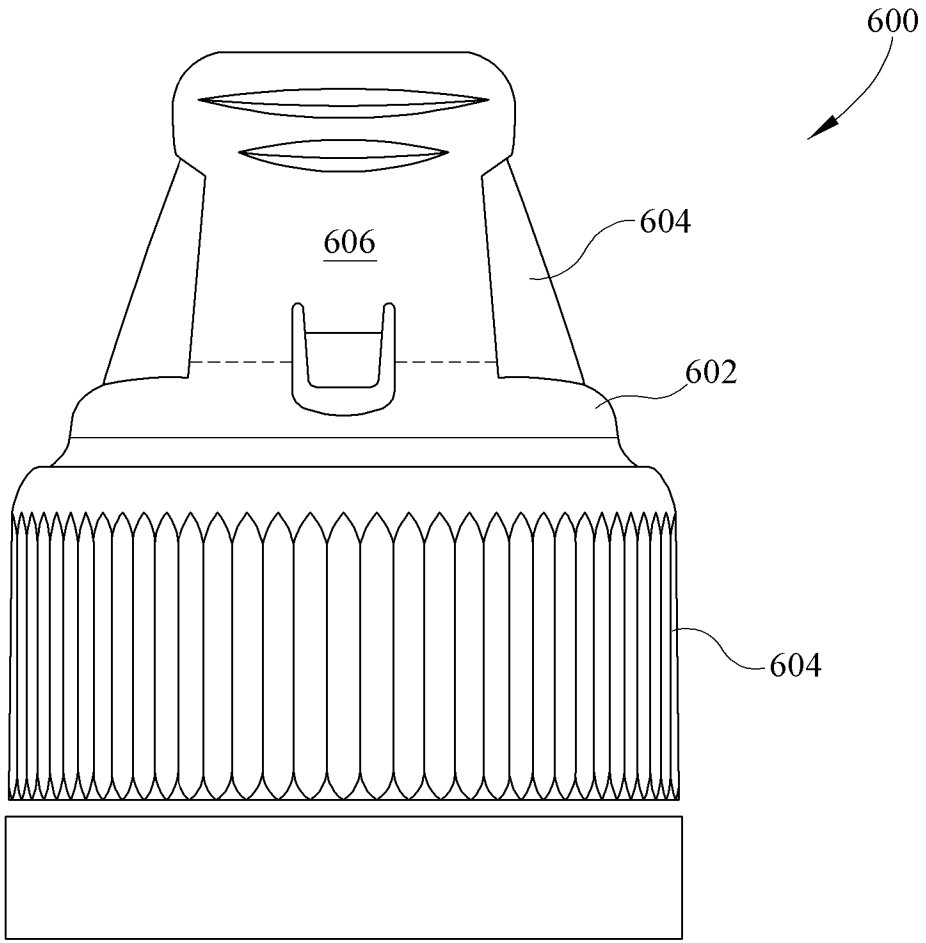
FIG. 8 is rear view of an alternate exemplary hinge structure for the closure of FIG. 1.
Figure 9:
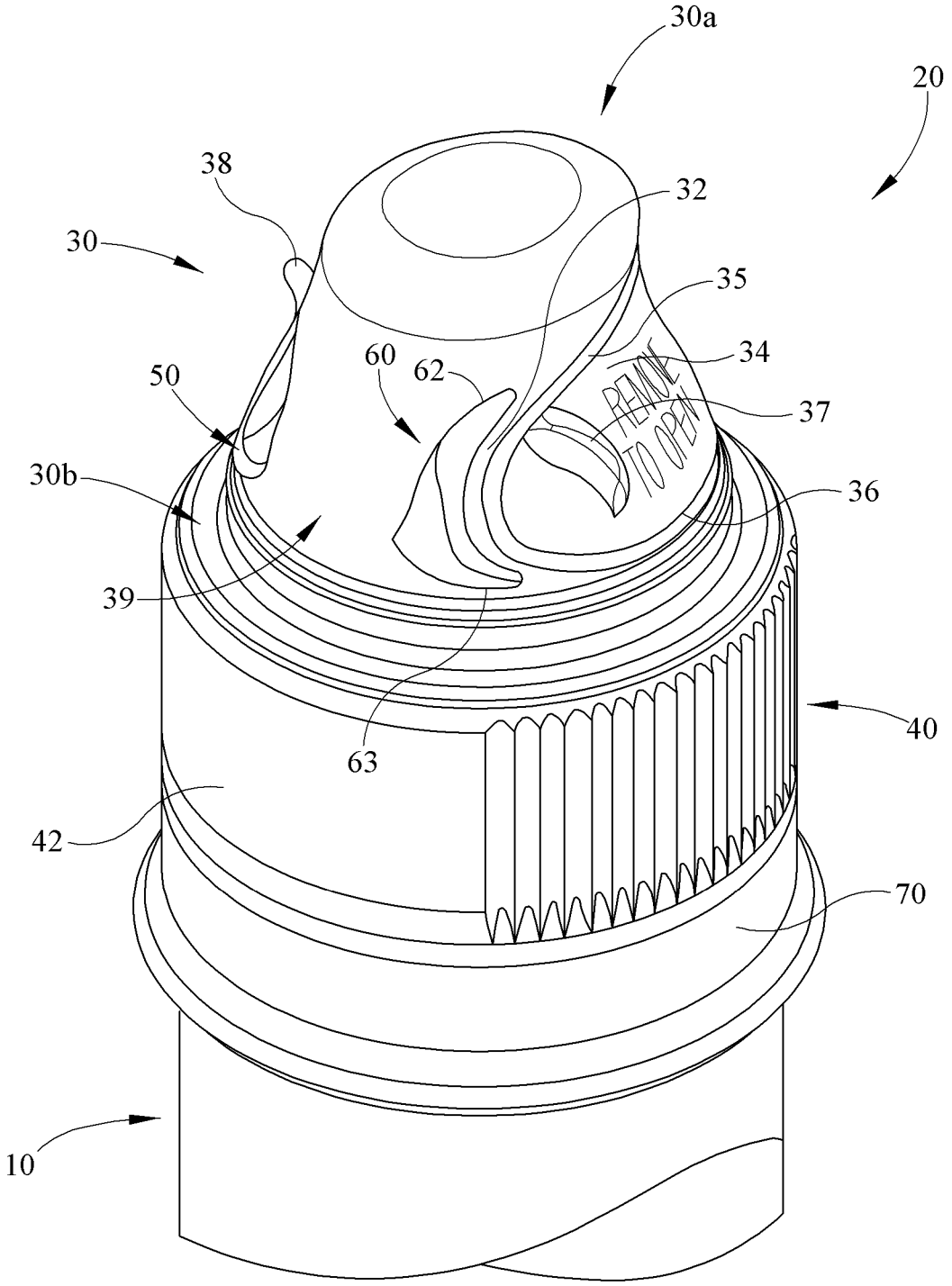
FIG. 9 is a rear, top perspective view of an embodiment of a two shot dispenser in a closed configuration.

Referring to FIG. 8, an alternate exemplary hinge structure 600 is shown. This exemplary hinge 600 is analogous to the living hinge 474 of FIG. 1 and may be used in lieu of the living hinge 474 of FIG. 1. The hinge line is shown with a dotted line and is vertically elevated with respect to the living hinge 474 of FIG. 1. It should be noted that his hinge structure 600 provides for a continuous ring 602 around the circumference of the base 604 to inhibit rotation of the cap 606 about the base.

As shown in FIG. 9-16, one embodiment of the mold-in-place two shot seal, includes a two shot dispenser 20. Two shot dispenser 20 is provided having a dispensing feature that is recloseable with a peel apart bond molded seal which facilitates a tight and engaging seal and reseal from being "molded closed" during manufacture. "Molded closed" refers that the two shot dispenser is molded in a closed configuration. Two shot dispenser 20 facilitates the dispensing of the contents of a tube, bottle or similar container. Two shot dispenser 20 comprises of an overshot 30 and an undershot 40. Overshot 30 is bond molded to the surfaces of undershot 40.

Figure 12:
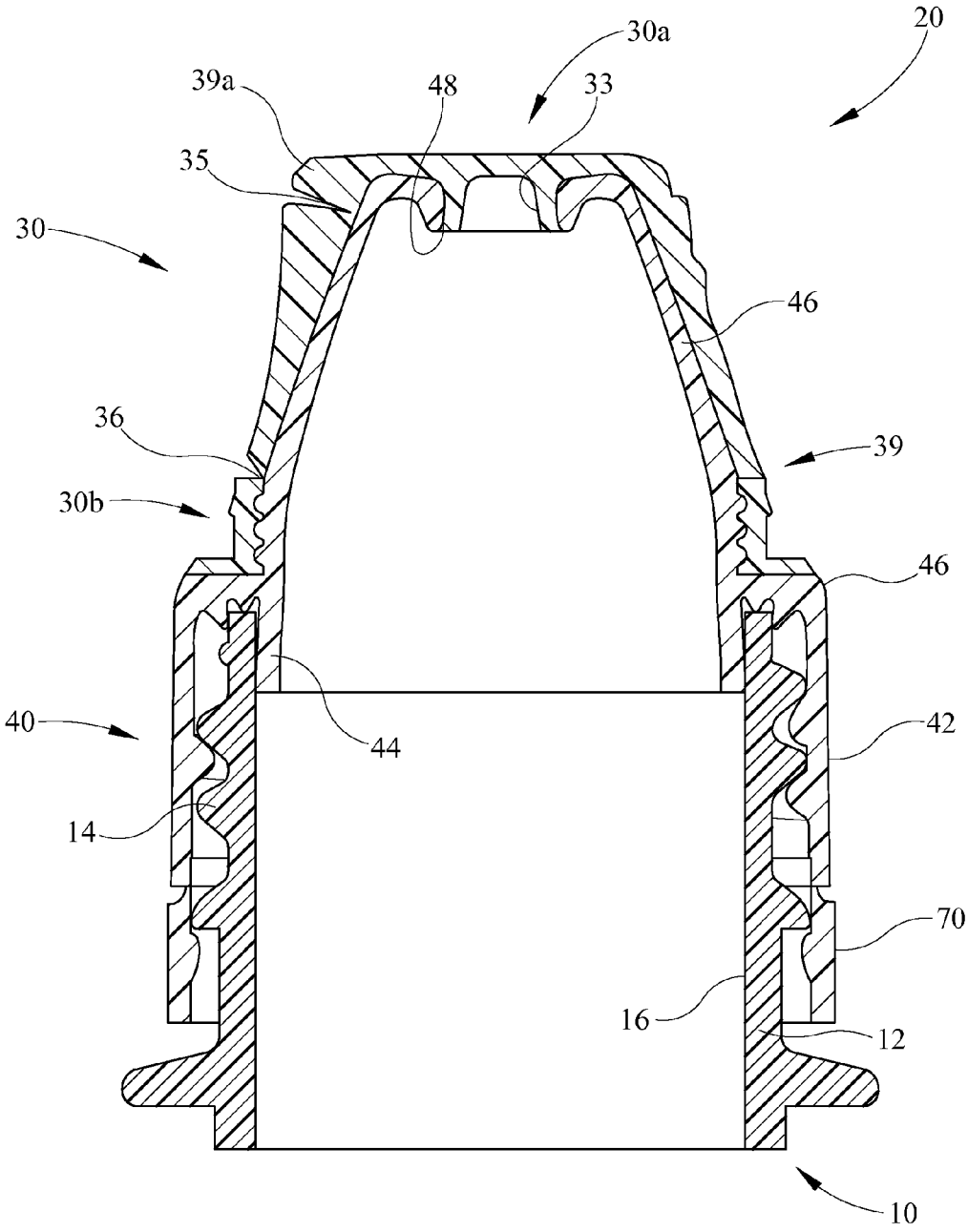
FIG. 12 is a sectional view of the two shot dispenser of FIG. 11 taken along the line AA.

As shown in FIG. 12, undershot 40 is threadably attached to a container finish 10. Container finish 10 has a neck 12 which defines an aperture 16 of the container. Undershot 40 has a top wall 46 in which an inner wall 44 and an outer wall 42 depend therefrom. Inner wall 44 creates a seal upon the interior surface of aperture 16 of container finish 10. Outer wall 42 threadably engages at least one thread 14 on the exterior of container neck 12. Outer wall 42 may also have a tamper indicating ring 70 depending therefrom that engages container finish 10. Tamper indicating ring 70 remains attached to container finish 10 if undershot 40 was partially removed or removed in its entirety. Overshot 30 is bond molded directly to the surface of the undershot 40. Overshot 30 may be molded to undershot 40 from top wall 46 up to and including a spout portion 46. Spout portion 46 contains an orifice 48 through which contents of the container are dispensed. However, orifice 48 of spout portion 46 is tightly sealed during the molding process. A depending skirt 33 of overshot 30 engages orifice 48 creating a "mold to fit orifice" seal, which will be described herein.

Although the container is shown in detail, it is merely representative of containers in general, and it is to be understood that there are many variations of containers that may be used with the two shot dispenser. It is also understood that undershot 40 may be removably as well as nonremoveably engaged to container finish 10 and still be within the spirit of the present invention.

As shown in FIGS. 9-13, overshot 30 may include a removable panel 34. Removable panel 34 functions as a line of demarcation between a flip-top cap 30*a* and a flip-top body 30*b*. Removable panel 34 divides flip-top cap 30*a* and body 30*b* about the hinge mechanism. An upper portion of removable panel 34 may be connected to flip-top cap 30*a* by a breakable web 35. While a lower portion of removable panel 34 may be connected to flip-top by a breakable web 36. These breakable webs 35, 36 acts as tamper indicating device. When a user pushes or pulls on either tabs 37, 38, the breakable webs 35, 36 can be broken which clears the line of demarcation between flip-top cap 30*a* and flip-top body 30*b*. With removeable panel 34 removed from overshot 30, the flip-top cap 30*a* can travel from a closed configuration (FIG. 9) to an open configuration (FIG. 14) about the hinge mechanism. A thumb or finger lift 39*a* is positioned on flip-top cap 30*a* to assist in opening. Portions of removable panel 34 may also be bond molded to undershot 40 as to aid in sealing and color differentiating for use as a tamper indicating device.

Figure 10:
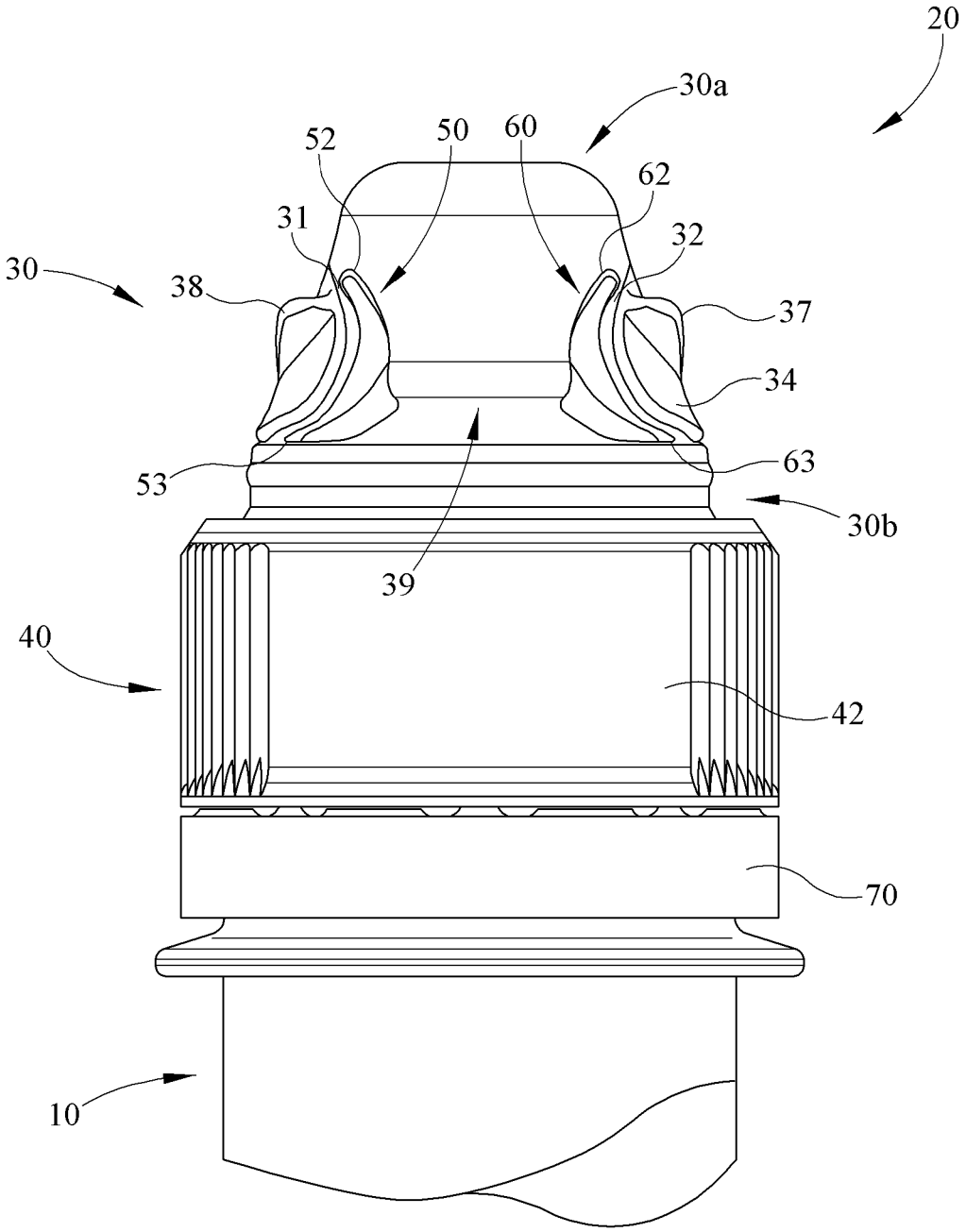
FIG. 10 is a rear view of the two shot dispenser of FIG. 9.
Figure 11:
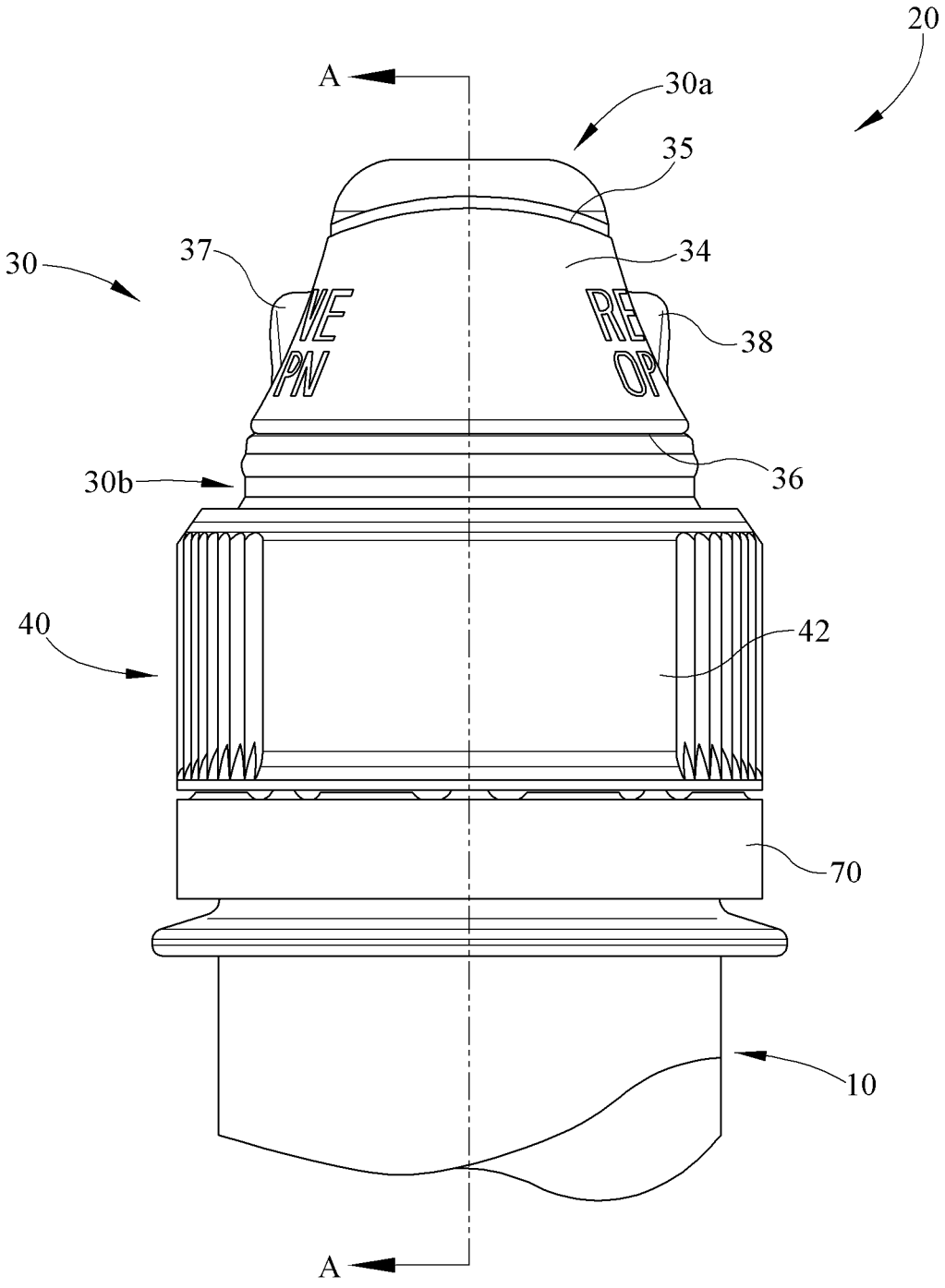
FIG. 11 is a front view of the two shot dispenser of FIG. 9.
Figure 13:
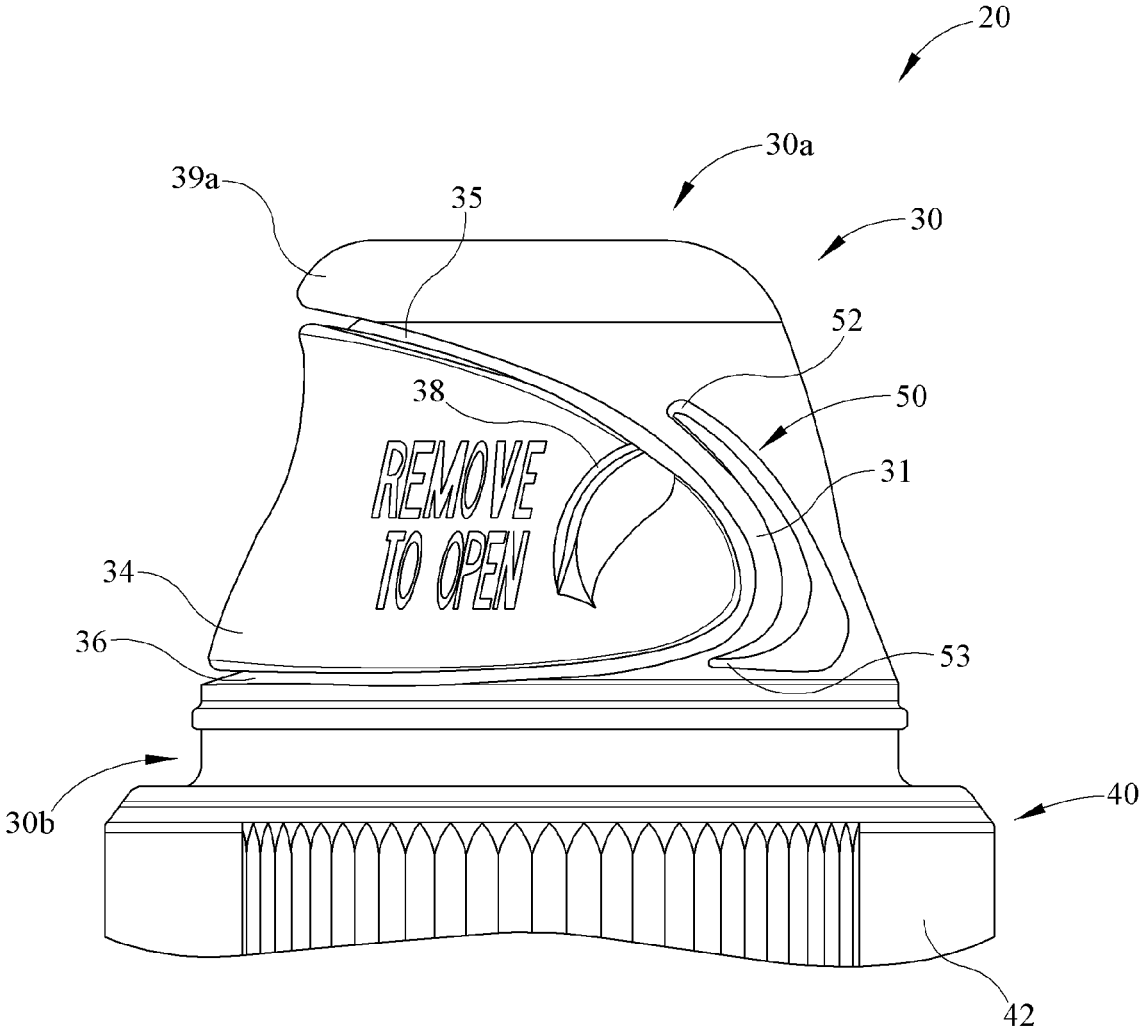
FIG. 13 is an enlarged, side view of the overshot of FIG. 9.
Figure 14:
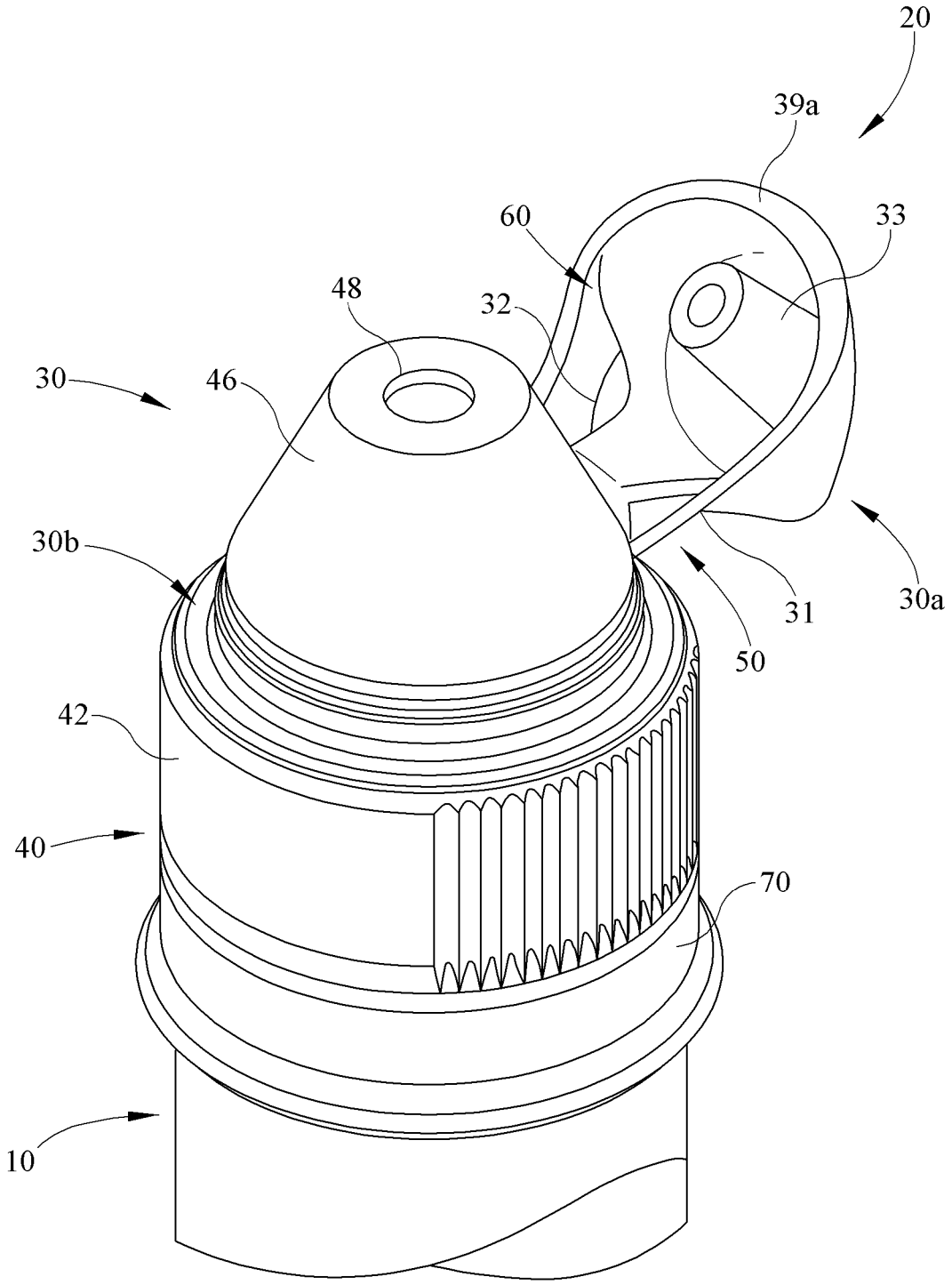
FIG. 14 is a top perspective view of the two shot dispenser of FIG. 9 in an open configuration.

The hinge mechanism of two shot dispenser 20 allows for the dispenser to be recloseable. Flip-top cap 30*a* can travel from an open configuration (FIG. 9) to a closed configuration (FIG. 14). In the open configuration contents (not shown) can be dispensed. As illustrated in FIGS. 9, 10, 13, and 14, the hinge mechanism of overshot 30 of two shot dispenser 20 comprises of a plurality of openings defining the hinge. The plurality of openings is substantially crescent shaped and are further defined as a left crescent opening 50 and a right crescent opening 60. Openings 50, 60 divide the hinge mechanism into a left hinge arm 31, a right hinge arm 32, and a center hinge 39. Each crescent opening 50, 60 have an upper arch 52, 62 and a lower arch 53, 63. As shown in FIGS. 10 and 13, left crescent opening 50 has upper arch 52 extending to a point over hinge arm 31 and lower arch 53 extending to a point under hinge arm 31. As shown in FIG. 10, right crescent opening 60 has upper arch 62 extending to a point over hinge arm 32 and lower arch 63 extending to a point under hinge arm 32. Each opening 50, 60 may also include tapering edges at various locations surrounding the interior of the opening to further expand the size of the opening and/or may aid in the cap to remain substantially open. A single taper or combination of different tapers located about the openings 50, 60 may be tapered or reverse tapered from the exterior surface of the flip-top cap. The hinge mechanism of two shot dispenser 20 allows flip-top cap 30*a* to travel to an open configuration (FIG. 9) wherein the cap is substantially open to allow dispensing of a variety of different contents known in the art. Interference by flip-top cap 30*a* in dispensing is minimized due to the maximization of the hinge mechanism to open the cap to a sufficient degree of clearance. The hinged flip-top cap 30*a* may flex below 90 degrees when in the open configuration. A user may drink from the dispenser without substantial interference from flip-top cap 30*a* as it remains fully open.

Although overshot 30 and undershot 40 is shown in detail, it is merely representative of one embodiment, and it is to be understood that there are many variations that may be used to create a two shot seal between an overshot and undershot. For example, a hinge does not have to be included as an option on the overshot. It is also understood that an overshot can be a removable cap bond molded ("closed molded") to an undershot and still be within the spirit of the present invention.

The mold-in-place two shot seal of dispenser 20 is capable of being molded in a closed position. There may be two separate steps in formation of the two shot dispenser 20. The first step in the mold process involves the creation of the undershot by injection molding. The second step in the mold process involves injection molding the overshot to the undershot. During the manufacturing of two shot dispenser 20, the dispenser is "molded closed". "Molded closed" is referring that overshot 30 is in its closed configuration (FIG. 9) when molded to undershot 40. Enhanced sealing capabilities between the overshot and undershot are created from being molded in a closed position. After the undershot is molded in the first mold cavity, the undershot may be rotated into a cooling position before being rotated into position for the second step of the molding process. During the second step of the process, the overshot is molded directly to the existing undershot. The temperature created during the molding of the overshot may be minimized in order to minimize the adverse effect of additional heat onto the existing undershot. The plastic material injected during the second step of the closed molded process should have a lower melting temperature than the plastic material injected during the first step of the process to minimize imperfections. One option would be to have an overshot comprising of polyethylene molded onto an undershot comprising of polypropylene. Another option, may be to have an overshot comprising of polypropylene molded onto an undershot comprising of polyethylene terephthalate. Different grades of plastic or combinations of plastics may be used in the formation of the two shot dispenser. If a hinge mechanism is required in the application of the two shot dispenser, an increase in change in temperature of the two plastic compounds' melting points should allow for a more resilient hinge. Although specific compounds were described above, it is to be understood that a variety of materials known in the art may be used within the formation of the closed positioned two shot mold and still be within the spirit of the present invention.

Because two shot dispenser 20 is "molded closed", the mold cavity is capable of substantially increasing the total number of molded parts per cycle due to the maximization of space within the mold cavity die. The two shot dispenser is molded closed instead of open. If molded open there is space in the mold cavity that is lost to the open configuration unlike that of a molded closed configuration which maximizes the available space within the die. Also, the lower melting temperature of the material needed for the second step of the molding process reduces the amount of heat needed during the molding of overshot. By creating a mold closed design, the two shot dispenser does not have to be handled in another manufacturing step for closing the overshot. Also, once the seal is created between the overshot and undershot the part may be shipped without any other action on the closure. From the previous description above, the design may increase efficiency of manufacture by reducing the handling of parts, removing the closing process of the overshot, increasing molded parts created per cycle, and reducing overhead costs such as, and not limited to, utilities.

The molding of the two shot dispenser 20 also creates a "mold to fit orifice". The "mold to fit orifice" is created when overshot 30 is molded in the second step of the molding process. In the "molded closed" position, overshot 30 is mildly bonded to undershot 40 during molding. The bond occurs during the second step of the molding process, wherein the female unitary mold is abutted up to the undershot portion of the dispenser. While the female unitary mold is abutted up undershot 40, the plastic material is injected creating the overshot 30. Because there is no metal mold cavity to metal mold cavity contact, overshot 30 is mildly bonded directly to the surface of undershot 40. This mild bond creates a substantially tight and engaging seal on a substantial portion of the surface area of contact between overshot 30 and undershot 40. The molded bond surface incorporates, but is not limited to, the planar surface surrounding aperture 48 of undershot 40 and undershot aperture 48 itself is also substantially sealed by depending skirt 33 creating a seal capable of being sealed directly upon molding. The molded seal or "mold to fit orifice" removes the need to add further sealing mechanisms known in the art because the seal created by overshot 30 directly matches the surface contours or imperfections of undershot 40. During each individualized second step of the mold process, each individual overshot 30 part is directly molded to a corresponding undershot 40 part, thus creating a bond that identically matches and is specific to the surface contours between the overshot and undershot. The seal created by the molded bond between overshot 30 and undershot 40 substantially minimizes leaks and makes the seal capable of withstanding carbonation or pressure from contents enclosed in container. The molded seal is immediately created upon completion of the molding of the two shot dispenser 20 which makes the seal of the dispenser ready to be used from the moment of creation without additional steps of manufacture.

Figure 15:
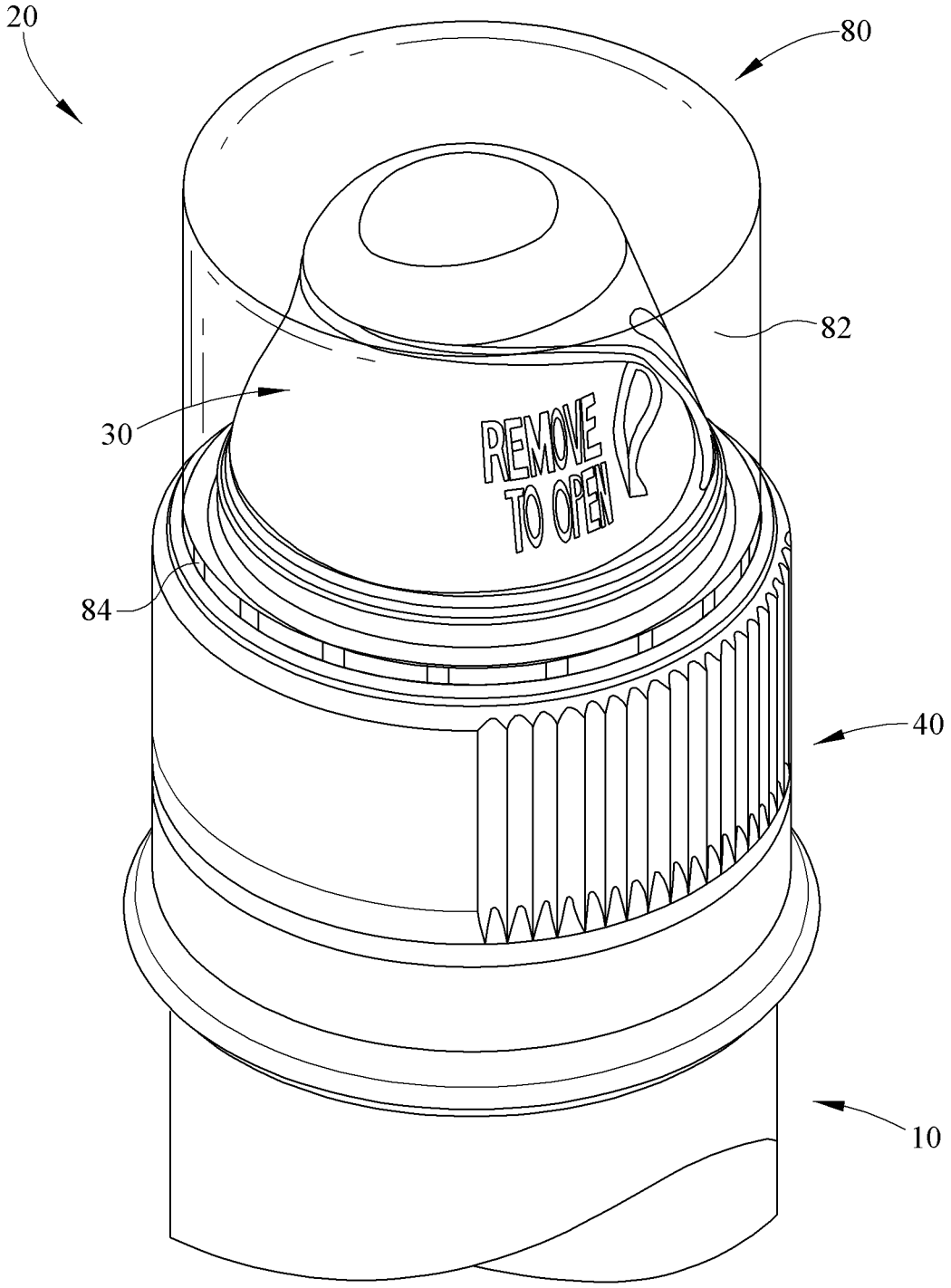
FIG. 15 is a top perspective view of the two shot dispenser of FIG. 9 illustrating a dust cover.
Figure 16:
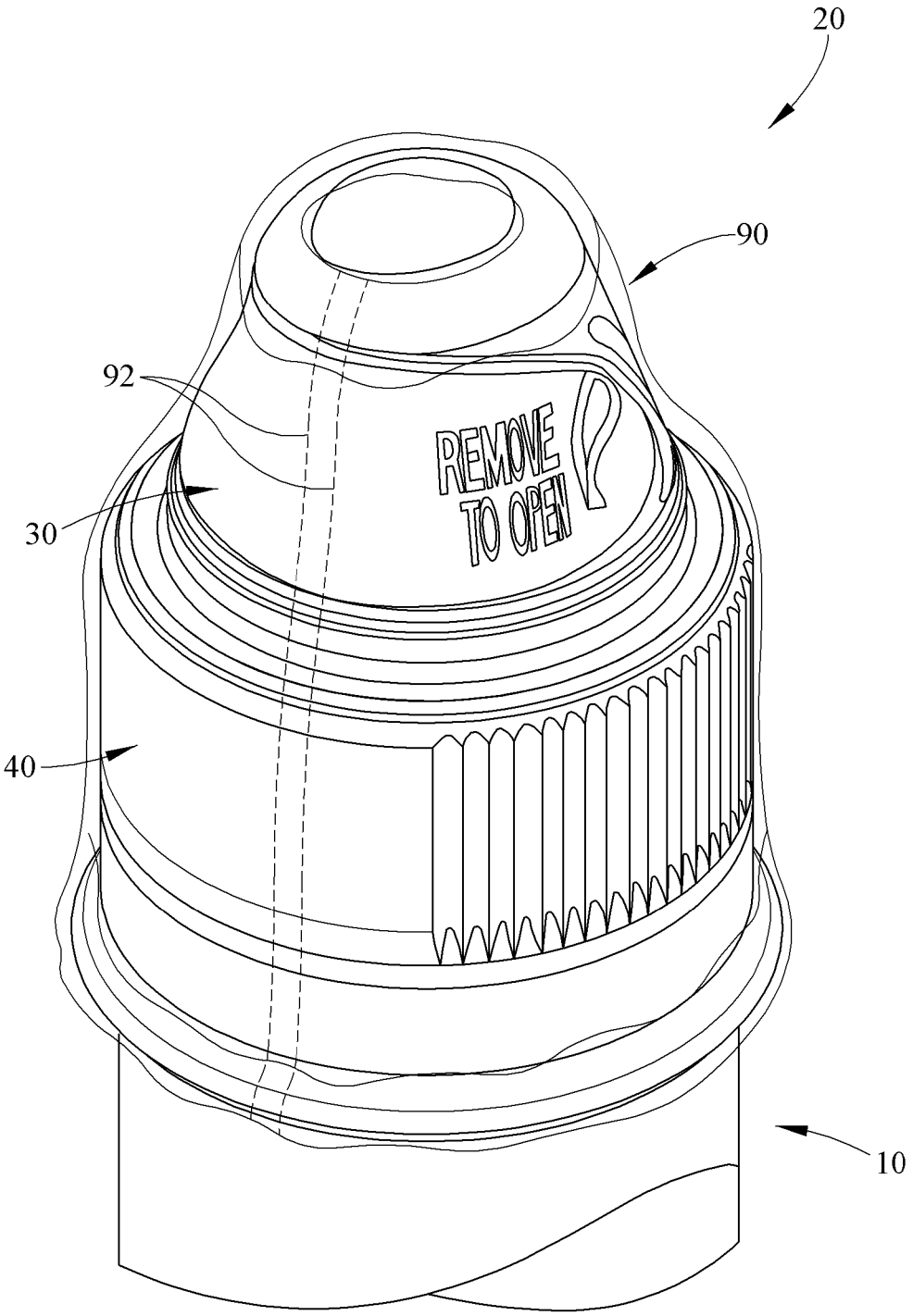
FIG. 16 is a top perspective view of the two shot dispenser of FIG. 9 illustrating a shrink wrap.

There are numerous tamper indicating devices which can be used individually or in combination with each other in support of two shot dispenser 20. There is a visual indicator created because of the mild bond of the seal between overshot 30 and undershot 40. The mild bond creates a color differentiation between an overshot that has been opened to an open configuration (FIG. 14) versus an overshot that has been in a closed configuration (FIG. 9) since being "closed molded". Once the overshot is first opened the color between flip-top cap 30*a* and spout portion 46 is no longer substantially identical to the mild bond color when dispenser 20 was first created during the "closed molded" process. As shown in FIG. 15, a dust cover 80 may also be used in conjunction with two shot dispenser 20 to indicate tampering of the dispenser. Dust cover 80 acts as an over cap 82 with a tamper evident ring 84 and minimize contaminants from coming into contact with the two shot dispenser 20. Tamper evident ring 84 may mechanically remain affixed to the two shot dispenser once over cap 82 is mechanically rotated and removed to indicate tampering or a taper evident tab (not shown) may be torn off separately from the over cap before removal of the over cap. Another indicator for tampering may be removable panel 34 created during the second step of the overshot creation process. Removable panel 34 may encompass and wrap around a substantial front portion of spout portion 46 of undershot 40. Removable panel 34 comprises of an upper and lower tear away web 35, 36 as shown in FIG. 13. The upper and lower tear away web 35, 36 may not extend to the terminating ends of the removable panel allowing for the user to push or pull upon tabs 37, 38 for removal. Tabs 37, 38 aids in the user to start and/or remove removable panel 34. Tabs 37, 38 may be located on either end of the removable panel. Typically the tear away breakable web 35, 36 may be created by a score line or molded as a thin section of plastic material. Removable panel 34 also may have the visual color indicator created by the mold bond between overshot 30 and undershot 40 as described above. As shown in FIG. 16, a shrink wrap 90 may be used to also indicate tampering of two shot dispenser 20. Shrink wrap 90 should encompass a substantial amount of two shot dispenser 20. Shrink wrap 90 may be made of a plastic that wraps tightly around the two shot dispenser. Shrink wrap may be removed by a user at a point of weakness or by a perforation 92 in the plastic or by any other means known in the art. As described above and shown in FIGS. 9-12, undershot 40 may also have tamper indicating ring 70 depending from outer wall 42 and affixed to the container neck 12. If undershot 40 were to be mechanically removed by rotating off the closure from the container the tamper indicating ring would separate from the undershot and remain upon the container neck indicating tampering. A score line creating the tamper indicating ring 70 may be scored by a subsequent cutter operation or molded to define the tear away score line. It is to be understood that any tampering indicator known in the art may be used and still be within the scope of the present invention.

Figure 17:
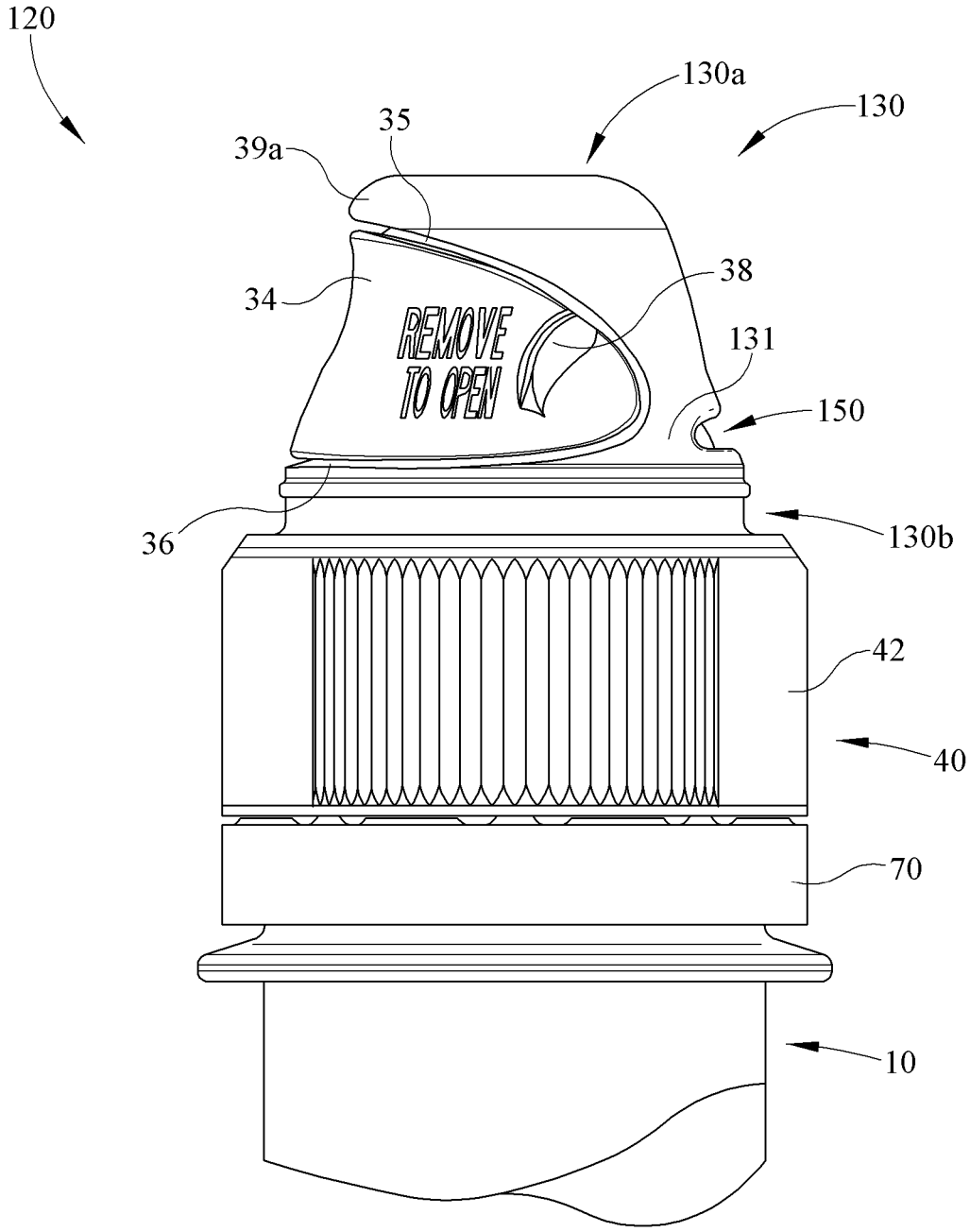
FIG. 17 is a side view of another embodiment of a two shot dispenser in a closed configuration.
Figure 18:
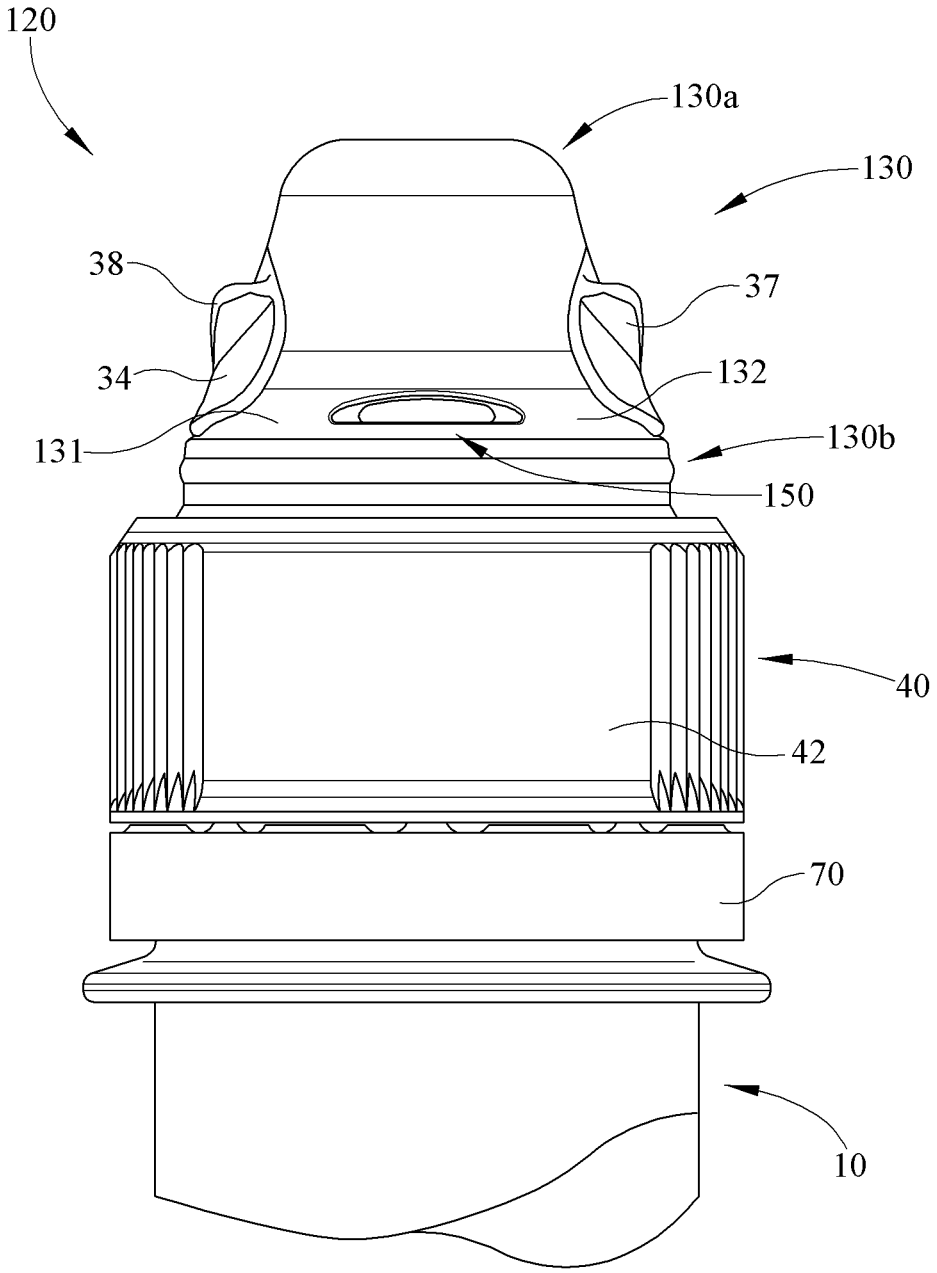
FIG. 18 is a rear view of the embodiment of FIG. 17 illustrating the hinge mechanism.
Figure 19:
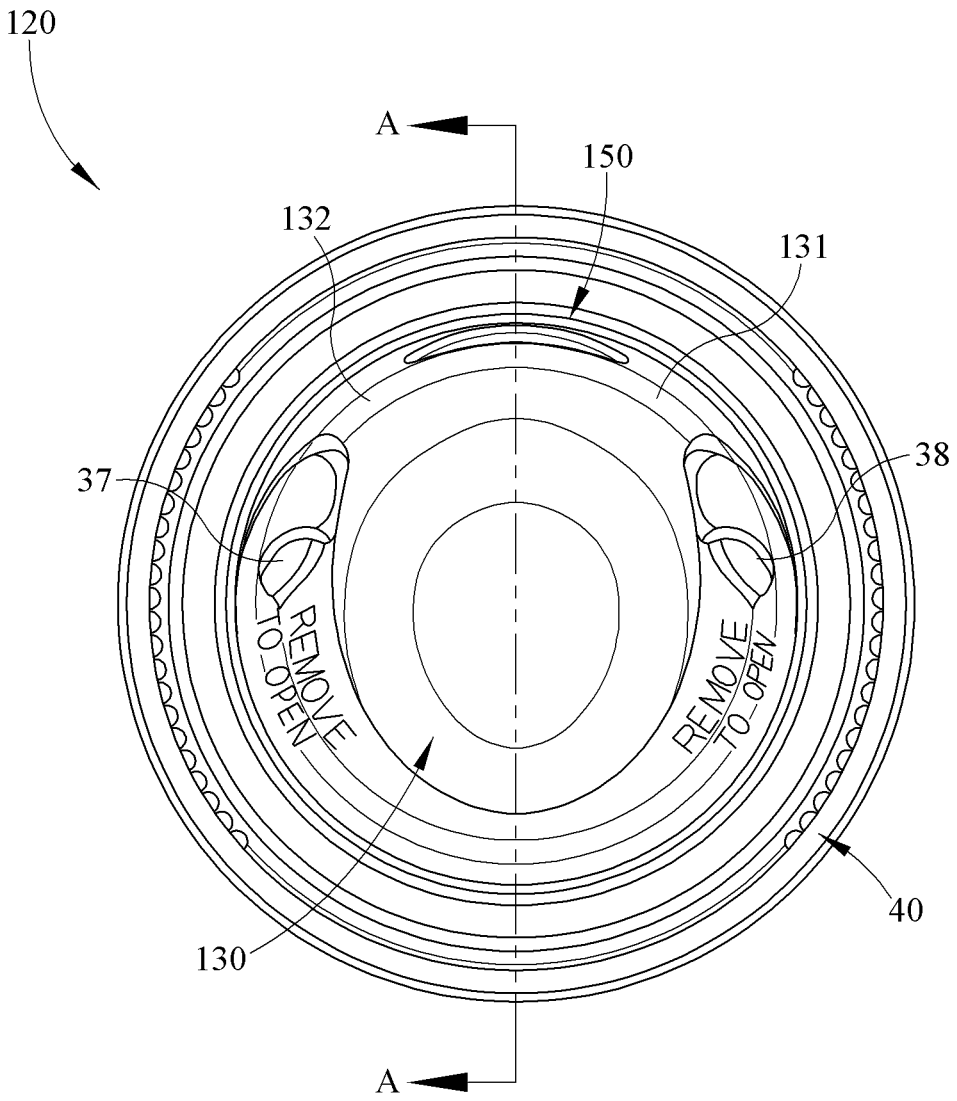
FIG. 19 is a top view of the embodiment of FIG. 17.
Figure 20:
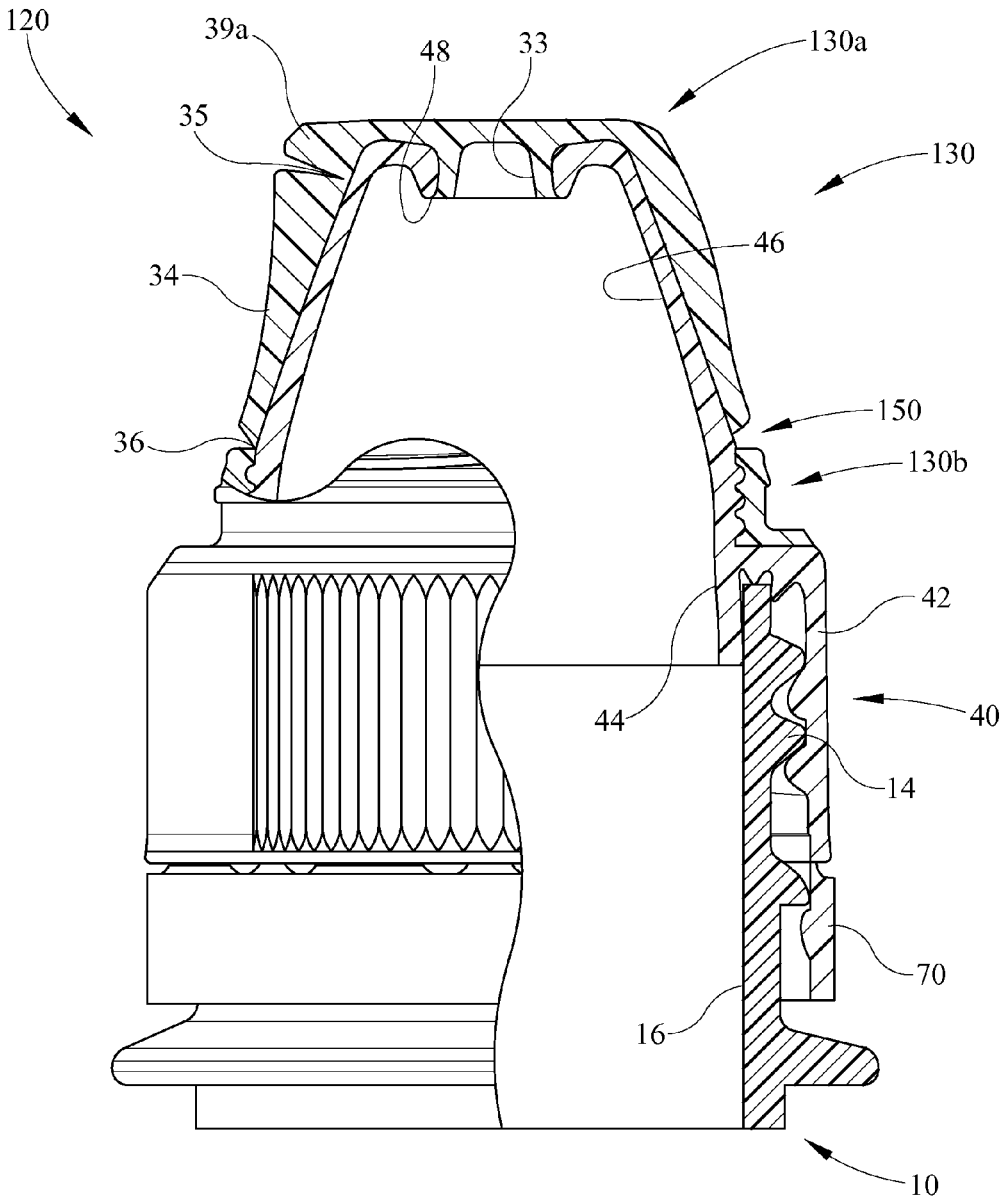
FIG. 20 is a partial sectional view of the two shot dispenser of FIG. 17 with portions of the two shot dispenser partially broken away.
Figure 21:
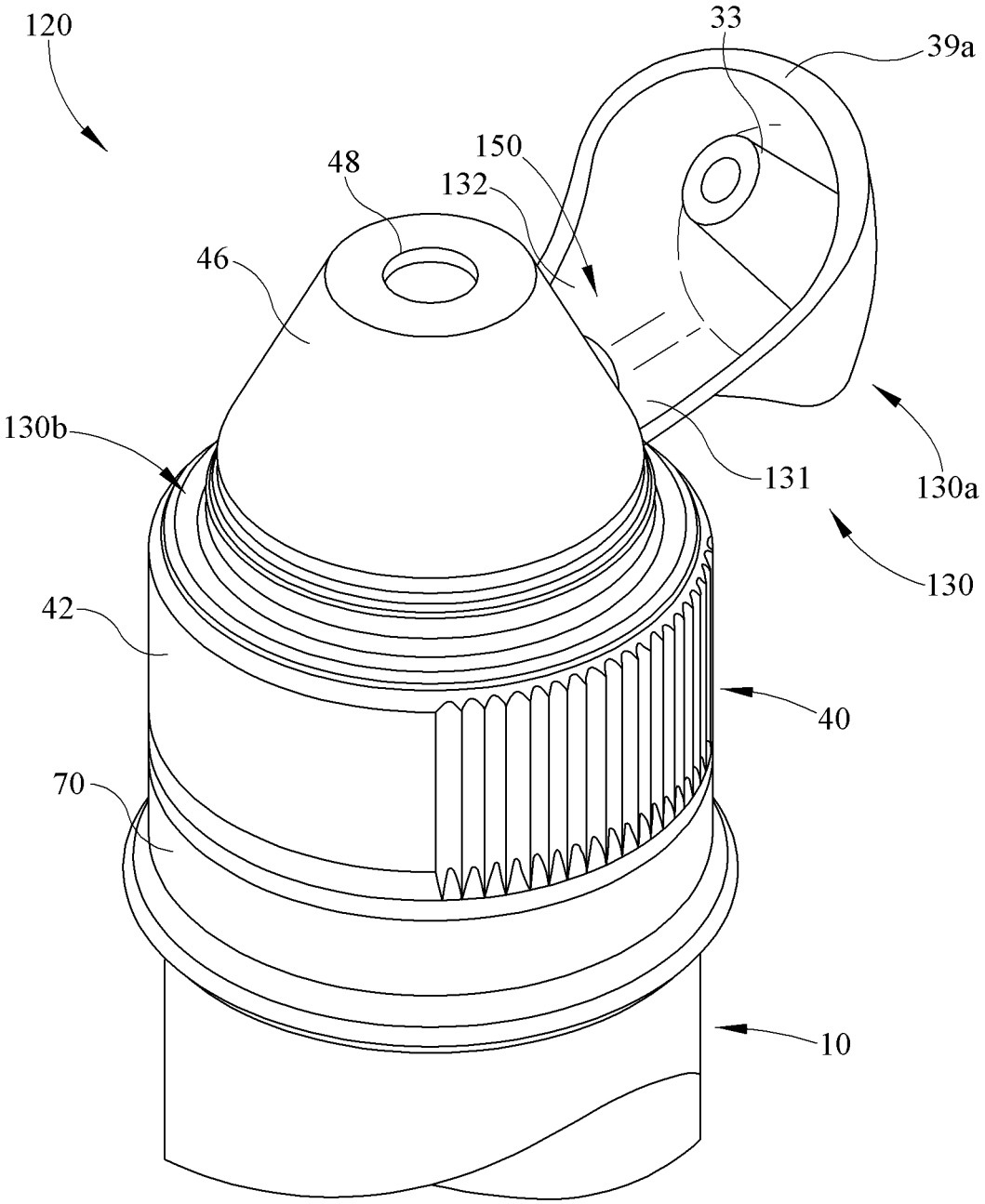
FIG. 21 is a top perspective view of the two shot dispenser of FIG. 17 in an open configuration.

Another embodiment of overshot 30, illustrated as reference 130 of a two shot dispenser 120 as illustrated in FIGS. 17-21, allows for another hinge mechanism to be used to allow for the opening and closing of the dispenser. The hinge mechanism of two shot dispenser 120 allows for the dispenser to be recloseable and tightly sealed. The hinge mechanism separates a flip-top cap 130*a* from a flip-top base 130*b* of overshot 130. Flip-top cap 130*a* can travel from an open configuration (FIG. 21) to a closed configuration (FIG. 17). In the open configuration contents (not shown) can be dispensed. As illustrated in FIGS. 17-21, the hinge mechanism of overshot 130 of two shot dispenser 120 comprises of an opening 150 defining the hinge. The opening is, but is not limited to, a substantially elliptical shaped opening. Opening 150 can also have taper extending around or portions of the perimeter of the opening. The taper assists in allowing the hinge mechanism to keep the flip-top cap substantially open. Opening 150 divide the hinge mechanism into a left hinge arm 131 and a right hinge arm 132. The hinge mechanism of two shot dispenser 120 allows flip-top cap 130*a* to travel to an open configuration (FIG. 21) wherein the cap is substantially open to allow dispensing of a variety of contents known in the art. Interference by flip-top cap 130*a* in dispensing is minimized due to the maximization of the hinge mechanism to open the cap to a sufficient degree of clearance. The hinged flip-top cap 130*a* may flex below 90 degrees when in the open configuration. A user may drink from the dispenser without substantial interference from flip-top cap 130*a*.

It is understood that while certain embodiments of the invention have been illustrated and described, it is not limited thereto except insofar as such limitations are included in the following claims and allowable functional equivalents thereof.

What is claimed is:

1. A two shot dispenser comprising:

a dispenser including an undershot of a first material and an overshot of a second material, said first material is different from said second material, said undershot includes a flip-top base and said overshot includes a flip-top cap overmolded onto said flip-top base in a closed position, said flip-top base having at least one thread;

said flip-top base of said undershot having a top wall with an aperture through said top wall, said top wall including an inner wall and an outer wall depending from said top wall, said outer wall and said inner wall being concentrically aligned;

said flip-top cap of said overshot includes a hinge positioned between an upper portion and a lower portion of said flip-top cap, wherein said hinge of said overshot pivots said upper portion between said closed position and an open position relative to said lower portion of said flip-top cap and said flip-top base; and said flip-top cap upper portion of said overshot creating a seal between said overshot and said undershot, wherein said seal engages said aperture of said flip-top base top wall.

2. The two shot dispenser as in claim 1 wherein said seal releasably engages said aperture.

3. The two shot dispenser as in claim 1 wherein said lower portion of said flip-top cap secures said upper portion and said hinge to said flip-top base.

4. The two shot dispenser as in claim 1 wherein said hinge includes a center hinge, a left hinge arm, and a right hinge arm, wherein said center hinge is located between said left hinge arm and said right hinge arm, a first opening separates said left hinge arm from said center hinge and a second opening separates said right hinge arm from said center hinge.

5. The two shot dispenser as in claim 4, wherein said first opening and said right opening are substantially crescent shaped.

6. The two shot dispenser as in claim 5, wherein said first opening includes an upper arch and a lower arch, said upper arch of said first opening extends to a point above said left hinge arm, said lower arch of said first opening extends to a point below said left hinge arm, wherein said second opening includes an upper arch and a lower arch, said upper arch of said second opening extends to a point above said right hinge arm, said lower arch of said second opening extends to a point below said right hinge arm.

7. The two shot dispenser as in claim 5, wherein each said first opening and said second opening have a taper.

8. The two shot dispenser as in claim 1, wherein said hinge includes an opening, said opening divides a pair of hinge arms.

9. The two shot dispenser as in claim 8, wherein each said pair of hinge arms include a taper on an opposing edge opposite of said opening.

10. The two shot dispenser as in claim 8, wherein said opening is substantially oval in shape.

11. The two shot dispenser as in claim 8, wherein said opening is tapered from an exterior surface of said overshot.

12. A two shot dispensing closure affixed to a container and having a flip top hinged lid, comprising:

a undershot base of a first material having a skirt and at least one thread on an inner side wall of said skirt and an upwardly extending dispensing surface, said dispensing surface having an aperture for dispensing product from said container through said aperture;

said undershot base including a sealing member on an inner surface of said base in contact with a container preventing said product of said container from leaking around said base skirt;

an overshot flip top hinged lid of a second material overmolded in a closed position onto said undershot base, wherein said first material has a higher melting temperature than said second material;

said overshot flip top hinged lid having an attachment ring surrounding said dispensing surface and a lid hingedly attached by a hinge to said attachment ring, said lid having a fluidic seal contacting said aperture of said base dispensing surface to properly seal said aperture when overmolded in said closed position onto said undershot base;

wherein said hinge is a dual position hinge biasing said lid into said closed position and an open position.

13. The closure of claim 12 wherein said hinge has a first hinge strap and a second hinge strap.

14. The closure of 13 wherein said hinge includes a first and a second crescent shaped cutout forming said first hinge strap and said second hinge strap.

15. The closure of 14 wherein said first and said second crescent shaped cutout positions said lid substantially outward and away from said dispensing surface to allow a user to drink from said closure without contacting said hinged lid.

16. The closure of claim 12 wherein said hinged lid has a top surface which is parallel to a top surface of said closure base in which said aperture is located when said lid is in said closed position, said hinged lid top surface being more than 90 degrees relative to said top surface of said closure when said lid is in said open position.

17. A flip top closure having a separate second shot hinged lid, comprising:

a first shot closure base of a first material having an upwardly extending frustoconical dispensing surface with a dispensing orifice on a top wall;

a second shot hinged flip top lid of a second material overmolded onto said first shot closure base in a closed position, wherein said first material is different from said second material, said second shot hinged flip top lid includes a retention ring, hinge, and lid, said retention ring surrounds at least a portion of said closure at a base of said upwardly extending frustoconical dispensing surface and hinged to said lid, said hinge is overmolded directly against an exterior surface of said upwardly extending frustoconical dispensing surface and biases said lid between said closed position and an open position, said lid having a seal contacting said dispensing orifice of said first shot closure base top wall when said lid is in said closed position; and wherein said hinge biases said lid substantially away from said dispensing orifice when said lid is in said open position to prevent substantial interference of a user drinking from said dispensing orifice.

18. The closure of claim 17 wherein said hinge is formed of a first hinge strap and a second hinge strap, a first cutout forming said first hinge strap and a second cutout forming said second hinge strap.

19. The closure of claim 18 wherein said first cutout and said second cutout are mirrored crescent shaped cutouts.

20. The closure of claim 17 wherein said first shot closure base includes at least one circumferential groove receiving an overmolded portion of said retaining ring of said second shot hinged flip top lid to mount said hinged flip top lid to said first shot closure base.

* * * * *